US010920409B2

(12) United States Patent
Ko et al.

(10) Patent No.: US 10,920,409 B2
(45) Date of Patent: Feb. 16, 2021

(54) SANITARY WASHING APPARATUS

(71) Applicant: TOTO LTD., Kitakyushu (JP)

(72) Inventors: Yuki Ko, Kitayushu (JP); Masayuki Mochita, Kitakyushu (JP); Junki Hamada, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 0 days.

(21) Appl. No.: 16/542,928

(22) Filed: Aug. 16, 2019

(65) Prior Publication Data

US 2020/0056358 A1 Feb. 20, 2020

(30) Foreign Application Priority Data

Aug. 17, 2018 (JP) ..... 2018-153399
Aug. 17, 2018 (JP) ..... 2018-153402
Jan. 9, 2019 (JP) ..... 2019-001719

(51) Int. Cl.
*E03D 9/08* (2006.01)
*B05B 15/555* (2018.01)

(52) U.S. Cl.
CPC ..... *E03D 9/08* (2013.01); *B05B 15/555* (2018.02)

(58) Field of Classification Search
CPC ..... E03D 9/08; B05B 15/555
See application file for complete search history.

(56) References Cited

U.S. PATENT DOCUMENTS 8,161,580 B2 * 4/2012 Hashidume ..... E03D 9/08 4/420.4
2010/0162475 A1 7/2010 Hashidume et al.
2012/0284912 A1 * 11/2012 Kuang ..... E03D 9/08 4/443

FOREIGN PATENT DOCUMENTS

| | | | |
|---|---|---|---|
| CN | 204919744 | U | 12/2015 |
| CN | 106032681 | A | 10/2016 |
| EP | 3272953 | A1 | 1/2018 |
| JP | 2003-105837 | A | 4/2003 |
| JP | 2006-283399 | A | 10/2006 |
| JP | 2007-239247 | A | 9/2007 |
| JP | 5257859 | B2 | 8/2013 |
| JP | 2015-227606 | A | 12/2015 |
| JP | 2016-044474 | A | 4/2016 |
| JP | 2018-31162 | A | 3/2018 |
| JP | 2018-87459 | A | 6/2018 |
| KR | 10-2011-0098515 | A | 9/2011 |

* cited by examiner

*Primary Examiner* — Janie M Loeppke
(74) *Attorney, Agent, or Firm* — White & Case LLP

(57) ABSTRACT

According to one embodiment, a sanitary washing apparatus includes a private part washing nozzle configured to wash a human body private part, a tube configured to supply water to the private part washing nozzle, an incoming water connection part connected to an upstream side of the tube and configured to supply water to the tube, a casing storing the private part washing nozzle, the tube, and the incoming water connection part, and a nozzle wash part configured to wash the private part washing nozzle. The private part washing nozzle is curved upward to be convex, and has a first region positioned frontward of the nozzle wash part in an advanced state in which the private part washing nozzle advances from the casing. The incoming water connection part is provided under the private part washing nozzle, and is rotatable.

11 Claims, 11 Drawing Sheets

SANITARY WASHING APPARATUS

CROSS-REFERENCE TO RELATED APPLICATIONS

This application is based upon and claims the benefit of priority from Japanese Patent Application No. 2018-153399, filed on Aug. 17, 2018, No. 2018-153402, filed on August 17, and No. 2019-001719, filed on Jan. 9, 2019; the entire contents of which are incorporated herein by reference.

FIELD

Embodiments described herein relate generally to a sanitary washing apparatus.

BACKGROUND

Recently, a design of a lower silhouette than before has been demanded in a sanitary washing apparatus. In this status, a nozzle unit including a private part washing nozzle (hereinafter, referred to as simply "nozzle") which washes a human body private part limits a height of the sanitary washing apparatus.

As a method for lowering the height of the sanitary washing apparatus, it is conceived that the backward of a sit-down toilet (hereinafter, referred to as simply "toilet") is hollowed and the toilet and the sanitary washing apparatus are unified. However, with this method, the sanitary washing apparatus can be attached only with a dedicated toilet. For that reason, a sheet type sanitary washing apparatus is favorable, which can be attached to any toilet and provided on an upper surface of the toilet. For the nozzle unit installed on the sheet type sanitary washing apparatus, it is conceived to make the nozzle curved upward in a convex shape as a means corresponding to lower silhouette while keeping a conventional washing point, a washing angle, a nozzle orbit not interfering with a bottom, a nozzle advance point not submerged when washing the toilet, or the like.

However, when the nozzle is made upward in a convex shape, liquid waste or solid waste or the like adhered to the nozzle during private part washing may flow backward the nozzle along the outer surface of the nozzle after storing the nozzle. Thereby, for example, the liquid waste or the like may drip in an inner part (portion behind the nozzle) of a casing storing the nozzle, and dirt may accumulate around a functional unit or the like provided in the inner part.

A tube which supplies water to the nozzle is connected to the nozzle, and moves with the action of the nozzle. For that reason, when the liquid waste or the like is adhered to the tube, depending on a routing of the tube, the dirt may diffuse into the peripheral member or the inner part of the casing when the tube moves.

SUMMARY

According to the embodiment, a sanitary washing apparatus includes a private part washing nozzle configured to wash a human body private part; a tube configured to supply water to the private part washing nozzle; an incoming water connection part connected to an upstream side of the tube and configured to supply water to the tube; a casing storing the private part washing nozzle, the tube, and the incoming water connection part; and a nozzle wash part configured to wash the private part washing nozzle, the private part washing nozzle being curved upward to be convex, and advancing and retreating along a virtual orbit having an arc shape, the private part washing nozzle having a first region positioned frontward of the nozzle wash part in an advanced state in which the private part washing nozzle advances from the casing, in a stored state in which the private part washing nozzle is stored in an interior of the casing, a back end of the first region being positioned at a top positioned directly above a curvature center of an arc of the virtual orbit, or frontward of the top, the incoming water connection part being provided under the private part washing nozzle, and being rotatable in accordance with advance and retreat action of the private part washing nozzle, the incoming water connection part being rotatable from a first rotation position in the stored state to a second rotation position in accordance with advance of the private part washing nozzle, and a connection portion of the incoming water connection part and the tube being positioned at a backward side of the incoming water connection part in the first rotation position and being positioned at an upward side of the incoming water connection part in the second rotation position.

DETAILED DESCRIPTION

Figure 1:
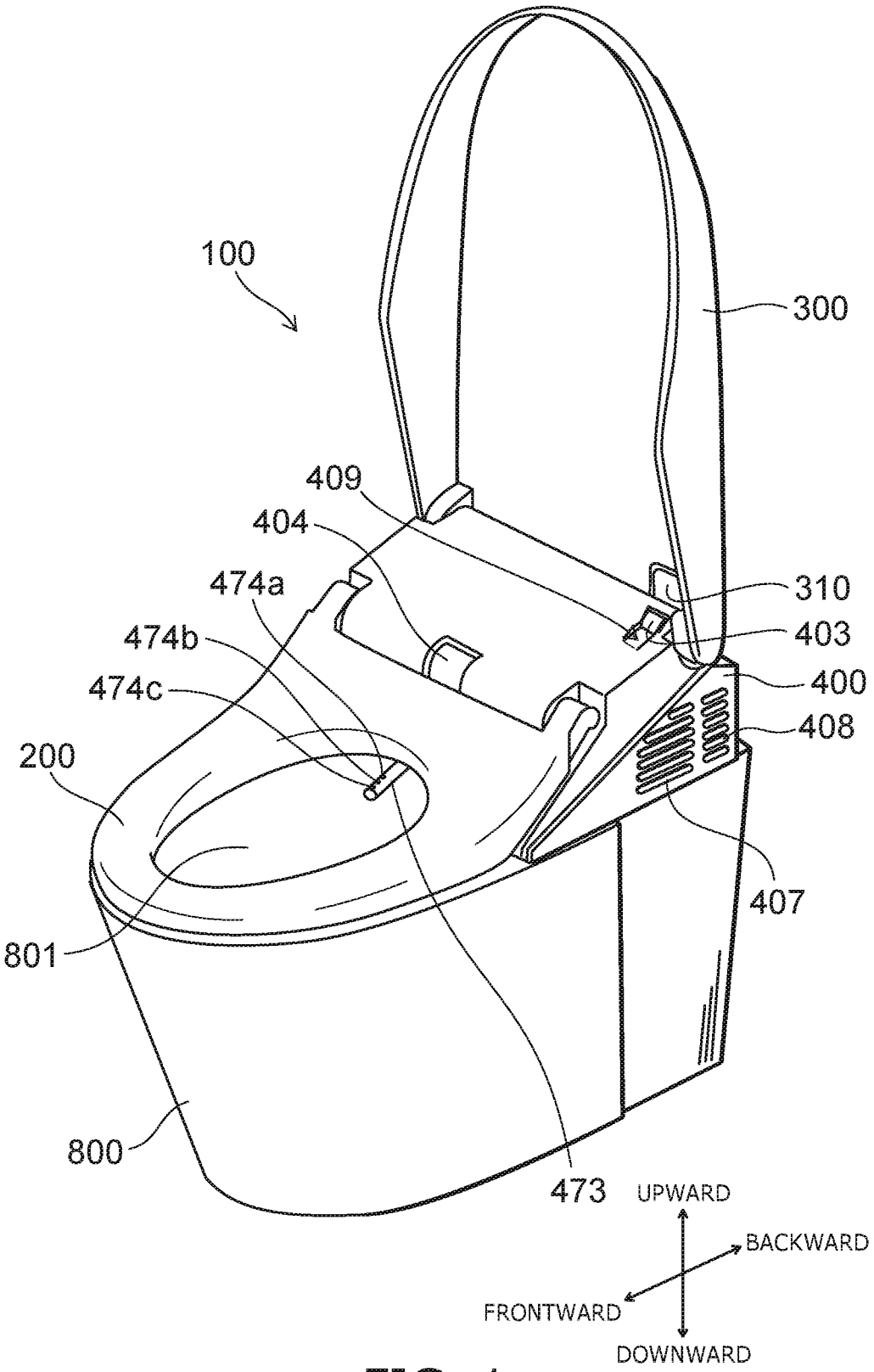
FIG. 1 is a perspective view schematically illustrating a toilet apparatus including a sanitary washing apparatus according to an embodiment.

The first invention relates to a sanitary washing apparatus. The sanitary washing apparatus includes a private part washing nozzle configured to wash a human body private part, a tube configured to supply water to the private part washing nozzle, an incoming water connection part connected to an upstream side of the tube and configured to supply water to the tube, a casing storing the private part washing nozzle, the tube, and the incoming water connection part, and a nozzle wash part configured to wash the private part washing nozzle. The private part washing nozzle is curved upward to be convex, and advances and retreats along a virtual orbit having an arc shape. The private part washing nozzle has a first region positioned frontward of the nozzle wash part in an advanced state in which the private part washing nozzle advances from the casing. In a stored state in which the private part washing nozzle is stored in an interior of the casing, a back end of the first region is positioned at a top positioned directly above a curvature center of an arc of the virtual orbit, or frontward of the top. The incoming water connection part is provided under the private part washing nozzle, and is rotatable in accordance with advance and retreat action of the private part washing nozzle. The incoming water connection part is rotatable from a first rotation position in the stored state to a second rotation position in accordance with advance of the private part washing nozzle. A connection portion of the incoming water connection part and the tube is positioned at a backward side of the incoming water connection part in the first rotation position and is positioned at an upward side of the incoming water connection part in the second rotation position.

According to the sanitary washing apparatus, the nozzle unit can be made smaller in a vertical direction by making the private part washing nozzle curved upward in a convex shape. Thereby, the casing can be made smaller in the vertical direction. According to the sanitary washing apparatus, the back end of the first region where the liquid waste or the like is possibly adhered at the time of private part washing is set to be positioned at the top of the virtual orbit or frontward of the top in the stored state, and thus it can be suppressed that the liquid waste or the like adhered to the first region flows backward of the back end of the first region in the stored state. Thereby, it can be suppressed that the liquid waste or the like drips in the inner part of the casing, and the dirt accumulates in the inner part of the casing. According to the sanitary washing apparatus, the tube can be installed under the private part washing nozzle by providing the incoming water connection part under the private part washing nozzle. Thereby, a space under the private part washing nozzle can be effectively utilized as a range of motion of the tube, and the casing can be made smaller. Even when the liquid waste or the like is adhered to the tube, since the range of motion of the tube is the space under the private part washing nozzle, the dirt can be suppressed from diffusing to the peripheral members and the inner part of the casing by the motion of the tube. According to the sanitary washing apparatus, the incoming water connection part rotates in accordance with the advance and retreat action of the private part washing nozzle, and thus even when the tube positioned outside the private part washing nozzle becomes short by the advancement of the private part washing nozzle, the bend of the tube can be suppressed.

The second invention is the sanitary washing apparatus of the first invention, wherein in the stored state, a back end of the private part washing nozzle is positioned at a top of the virtual orbit or frontward of the top.

According to the sanitary washing apparatus, in the stored state, the back end of the private part washing nozzle is set to be positioned at the top VT of the virtual orbit VO or frontward of the top VT, and thus the liquid waste or the like can be suppressed from flowing backward of the back end of the private part washing nozzle in the stored state. Thereby, it can be further suppressed that the liquid waste or the like drips in the inner part of the casing and the dirt accumulates in the inner part of the casing.

The third invention is the sanitary washing apparatus of the first or second invention, wherein the incoming water connection part is provided to be substantially horizontal or inclined upward from upstream toward downstream.

According to the sanitary washing apparatus, the incoming water connection part is provided to be substantially horizontal or inclined upward from upstream toward downstream, and thus the tube can be suppressed from interfering with a bottom plate of the casing. Thereby, it can be suppressed that when the nozzle advances and retreats, the tube interferes with the bottom plate of the casing and thus friction occurs, and the load of the nozzle drive part (motor) can be reduced.

The fourth invention is the sanitary washing apparatus of the third invention, wherein a back end of the incoming water connection part is positioned frontward of the top of the virtual orbit.

According to the sanitary washing apparatus, the back end of the incoming water connection part is positioned frontward of the top of the virtual orbit, and thus a length of the tube can be ensured and bend of the tube can be suppressed.

The fifth invention is the sanitary washing apparatus of one of the first to fourth inventions, wherein the private part washing nozzle includes a first cylinder portion advancing from the casing and a second cylinder portion advancing from the first cylinder portion, the second cylinder portion includes a water discharge port, and in the stored state, the water discharge port is stored in an interior of the first cylinder portion.

According to the sanitary washing apparatus, the nozzle unit can be made smaller in a frontward and backward direction by making the nozzle a so-called multistage nozzle which includes the first cylinder portion advancing from the casing and the second cylinder portion advancing from the first cylinder portion. Thereby, the casing can be made smaller in the frontward and backward direction. According to the sanitary washing apparatus, in the stored state, the water discharge ports of the second cylinder portion are caused to be stored in the interior of the first cylinder portion, and thus the liquid waste or the like adhered to the periphery of the water discharge ports can be held back by the first cylinder portion when storing. Thereby, the liquid waste or the like can be suppressed from dripping in the inner part of the casing, and the dirt can be suppressed from accumulating in the inner part of the casing.

The sixth invention is the sanitary washing apparatus of one of the first to fifth inventions, further comprising: a cable rack for advancing the private part washing nozzle, the cable rack being curved in same direction as the virtual orbit in a side surface view.

According to the sanitary washing apparatus, the cable rack is caused to be curved in the same direction as the virtual orbit in a side surface view, and thus the nozzle can be advanced while keeping the curvature of the cable rack. Thereby, the distortion or the like of the cable rack when advancing and retreating the nozzle can be suppressed, and the advance and retreat action of the nozzle can be stabilized.

The seventh invention is the sanitary washing apparatus of one of the first to sixth inventions, wherein the tube includes a first part positioned outside the private part washing nozzle, in the stored state, at least a portion of the first part is curved in same direction as the virtual orbit in a side surface view, and in the advanced state, at least a portion of the first part is curved in same direction as the virtual orbit in a side surface view.

According to the sanitary washing apparatus, in the stored state, at least the portion of the first part is curved in the same direction as the virtual orbit in a side surface view, and in the advanced state, at least the portion of the first part is curved in the same direction as the virtual orbit in a side surface view, and thus the nozzle can be advanced while keeping the curvature of the tube in the stored state. Thereby, bend and distortion or the like of the tube when advancing and retreating the nozzle can be suppressed, and the advance and retreat action of the nozzle can be stabilized.

The eighth invention is the sanitary washing apparatus of the seventh invention, wherein the incoming water connection part is provided at a position overlapping the private part washing nozzle in a top view.

According to the sanitary washing apparatus, the incoming water connection part is provided at a position overlapping the private part washing nozzle 473 in a top view, and thus the bend and the distortion of the tube when advancing and retreating the private part washing nozzle can be further suppressed and the advance and retreat action of the private part washing nozzle can be made more stable.

The ninth invention is the sanitary washing apparatus of the seventh or eighth invention, wherein the private part washing nozzle includes a guide which makes the tube curved downward.

According to the sanitary washing apparatus, the private part washing nozzle is provided with the guide which makes the tube curved downward, and thus the tube can be suppressed from being curved upward when advancing and retreating the private part washing nozzle. Thereby, the tube can be suppressed from interfering with the other members or the like above the private part washing nozzle.

The tenth invention is the sanitary washing apparatus of the ninth invention, wherein the private part washing nozzle includes a first cylinder portion advancing from the casing and a second cylinder portion advancing from the first cylinder portion, and the guide is the first cylinder portion.

According to the sanitary washing apparatus, the nozzle unit can be made smaller in a frontward and backward direction by making the nozzle a so-called multistage nozzle which includes the first cylinder portion advancing from the casing and the second cylinder portion advancing from the first cylinder portion. Thereby, the casing can be made smaller in the frontward and backward direction. According to the sanitary washing apparatus, the first cylinder portion is set to be the guide, and thus the tube can be suppressed from curved upward by a more simple structure when advancing and retreating the private part washing nozzle.

The eleventh invention is the sanitary washing apparatus of the seventh invention, further comprising: a nozzle drive part which makes the private part washing nozzle advance and retreat, at least a portion of the nozzle drive part being provided under the washing nozzle.

According to the sanitary washing apparatus, by providing at least the portion of the nozzle drive part under the nozzle, the space under the nozzle can be effectively utilized as a range of motion of the nozzle drive part and the casing can be made smaller.

Various embodiments are described below with reference to the accompanying drawings.

In the drawings, similar components are marked with like reference numerals, and a detailed description is omitted as appropriate.

FIG. 1 is a perspective view schematically illustrating a toilet apparatus including a sanitary washing apparatus according to an embodiment.

As illustrated in FIG. 1, the toilet apparatus includes a sit-down toilet (toilet) 800, and a sanitary washing apparatus 100 provided on the toilet 800. The sanitary washing apparatus 100 includes a casing 400, a toilet seat 200, and a toilet lid 300. The toilet seat 200 and the toilet lid 300 are pivotally supported to be openable and closable with respect to the casing 400.

A private part wash functional unit and the like that realize washing of a private part such as a "bottom" and the like of a user sitting on the toilet seat 200 are built in the interior of the casing 400. The private part wash functional unit includes, for example, a nozzle unit. Also, for example, a seat contact detection sensor 404 configured to detect the user sitting on the toilet seat 200 is provided in the casing 400. In the case where the seat contact detection sensor 404 detects the user sitting on the toilet seat 200, a private part washing nozzle (nozzle) 473 can be caused to advance into a bowl 801 of the toilet 800 and to retreat from the bowl 801 when the user operates, for example, an operation unit 500 (see FIG. 2) such as a remote controller. In the sanitary washing apparatus 100 illustrated in FIG. 1, the nozzle 473 is illustrated in the state of being advanced into the bowl 801.

The nozzle 473 discharges water (wash water) toward a human body private part, and performs the washing of the human body private part. A bottom wash water discharge port 474*a*, a soft wash water discharge port 474*b*, and a bidet wash water discharge port 474*c* are provided in the tip portion of the nozzle 473. The nozzle 473 can wash the "bottom" of the user sitting on the toilet seat 200 by squirting water from the bottom wash water discharge port 474*a* or the soft wash water discharge port 474*b* provided in the tip portion. Alternatively, the nozzle 473 can wash a female private part of a woman sitting on the toilet seat 200 by squirting water from the bidet wash water discharge port 474*c* provided in the tip portion. "Water" referred to in the specification of the application includes not only cold water but also heated warm water.

A mode of washing the "bottom" includes, for example, "bottom wash", and "soft wash" in which the bottom is washed gently by water flow softer than "bottom wash". The nozzle 473 can perform, for example, "bottom wash", "soft wash", and "bidet wash".

In the nozzle 474 illustrated in FIG. 1, the bidet wash water discharge port 474*c* is provided on a tip portion side of the nozzle 473 from the soft wash water discharge port 474*b*, and the soft wash water discharge port 474*b* is provided on the tip portion side of the nozzle 473 from the bottom wash water discharge port 474*a*, however installation positions of the bottom wash water discharge port 474*a*, the soft wash water discharge port 474*b*, and the bidet wash water discharge port 474*c* are not limited thereto. In the nozzle 473 illustrated in FIG. 1, three water discharge ports are provided, however, for example, the soft wash water discharge port 474*b* may be omitted and four or more water discharge ports may be provided.

In the embodiment, discharge angles of the bottom wash water discharge port 474*a*, a discharge angle of the soft wash water discharge port 474*b*, and a discharge angle of the bidet wash water discharge port 474*c* are different, respectively. The discharge angle is, for example, an angle (inferior angle) made between an upper surface of the toilet 800 and the discharged water. The discharge angle of the bottom wash water discharge port 474*a* is, for example, about 43 degrees.

The discharge angle of the soft wash water discharge port 474*b* is, for example, about 43 degrees. The discharge angle of the bidet wash water discharge port 474*c* is, for example, about 47 degrees.

Figure 2:
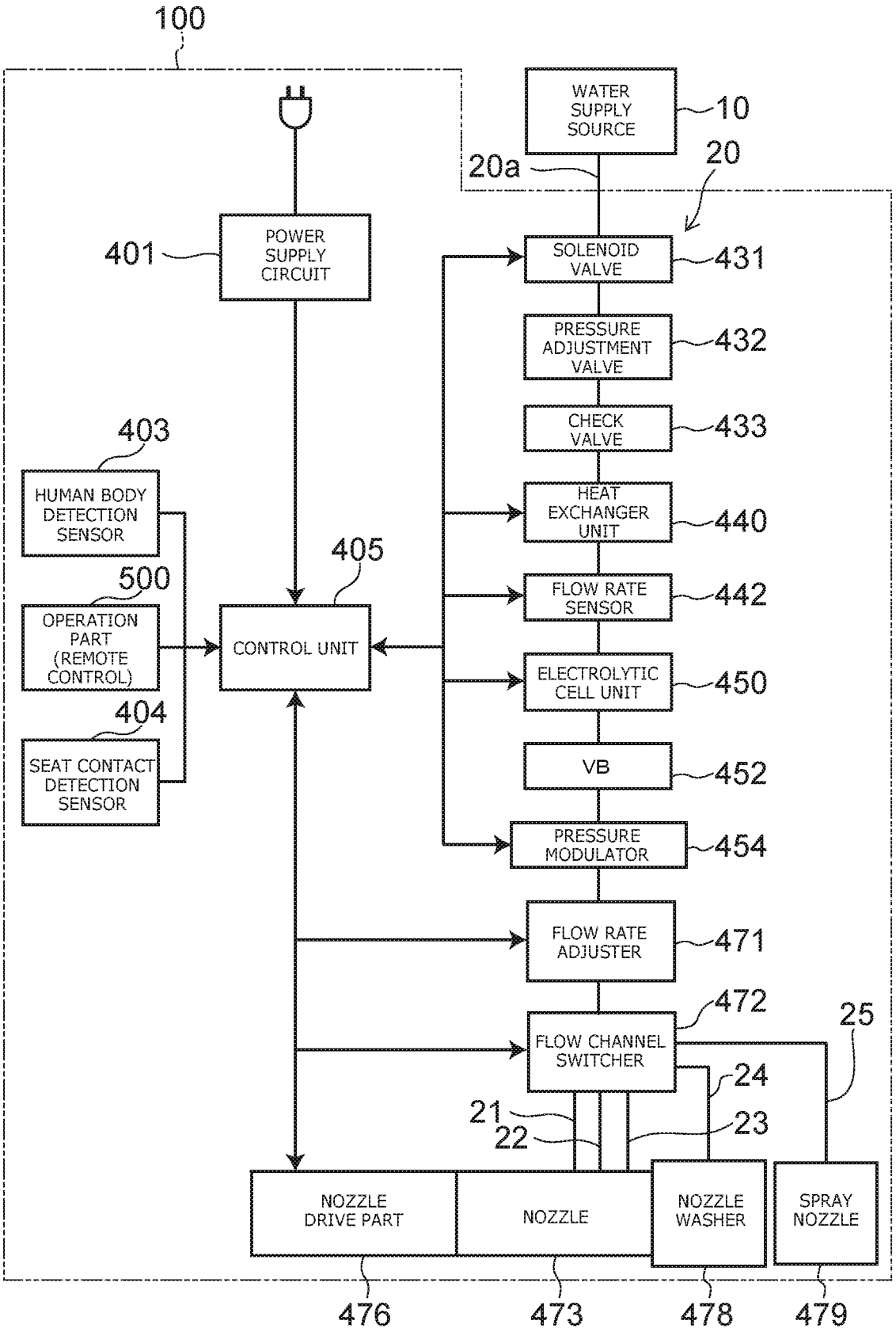
FIG. 2 is a block diagram schematically illustrating relevant configuration of the sanitary washing apparatus according to the embodiment.

FIG. 2 is a block diagram schematically illustrating the relevant configuration of the sanitary washing apparatus according to the embodiment.

FIG. 2 simultaneously illustrates the relevant configuration of the water channel system and the electrical system.

As illustrated in FIG. 2, the sanitary washing apparatus 100 includes a water transfer part 20. The water transfer part 20 includes a pipe line 20*a* from a water supply source 10 such as service water or water storage tank to the nozzle 473. The water transfer part 20 transfers the water supplied from the water supply source 10 to the nozzle 473 through the pipe line 20*a*. The pipe line 20*a* is formed of, for example, parts such as a solenoid valve 431, a heat exchanger unit 440 and a flow channel switch part 472 described below, and multiple piping connecting those parts.

The solenoid valve 431 is provided on the upstream side of the water transfer part 20. The solenoid valve 431 is an openable and closable solenoid valve, and controls the supply of water based on a command from a control unit 405 provided in the interior of the casing 400. In other words, the solenoid valve 431 opens and closes the pipe line 20*a*. The water supplied from the water supply source 10 flows into the pipe line 20*a* by opening the solenoid valve 431.

A pressure adjustment valve 432 is provided downstream of the solenoid valve 431. The pressure adjustment valve 432 adjusts the pressure in the pipe line 20*a* to a prescribed pressure range in the case where the water supply pressure is high. A check valve 433 is provided downstream of the pressure adjustment valve 432. The check valve 433 suppresses the back flow of the water to the upstream side from the check valve 433 in the case where the pressure in the pipe line 20*a* decreases.

The heat exchanger unit 440 (heating part) is provided downstream of the check valve 433. The heat exchanger unit 440 includes a heater, and heats the water supplied from the water supply source 10 to raise a temperature to a specified temperature, for example. That is, the heat exchanger unit 440 produces warm water.

The heat exchanger unit 440 is, for example, an instant heating type (instant type) heat exchanger based on a ceramic heater or the like, for example. The instant heating type heat exchanger can raise the temperature of the water to the specified temperature in a short time compared with a heat exchanger of warm water storage heating type based on a warm water storage tank. The heat exchanger unit 440 is not limited to the instant heating type heat exchanger and may be the heat exchanger of warm water storage heating type. The heating part is not limited to the heat exchanger, and may be, for example, a heating part based on other heating type such as microwave heating.

The heat exchanger unit 440 is connected to a control unit 405. The control unit 405 raises the temperature of the water to the temperature set by the operation unit 500, for example, by controlling the heat exchanger unit 440 depending on the operation of the operation unit 500 by the user.

A flow rate sensor 442 is provided downstream of the heat exchanger unit 440. The flow rate sensor 442 detects water flow rate discharged from the heat exchanger unit 440. That is, the flow rate sensor 442 detects the water flow rate flowing in the pipe line 20*a*. The flow rate sensor 442 is connected to the control unit 405. The flow rate sensor 442 inputs detection results of the flow rate to the control unit 405.

An electrolytic cell unit 450 is provided downstream of the flow rate sensor 442. The electrolytic cell unit 450 produces liquid (functional water) including hypochlorous acid from service water by electrolyzing the service water flowing in the interior. The electrolytic cell unit 450 is connected to the control unit 405. The electrolytic cell unit 450 produces the functional water based on the control by the control unit 405.

The functional water produced in the electrolytic cell unit 450 may be solution including, for example, metal ions such as silver ions, copper ions or the like. Alternatively, the functional water produced in the electrolytic cell unit 450 may be solution including electrolytic chlorine, ozone or the like. Alternatively, the functional water produced in the electrolytic cell unit 450 may be acidic water or alkaline water.

A vacuum breaker (VB) 452 is provided downstream of the electrolytic cell unit 450. The vacuum breaker 452 includes, for example, a flow channel for flowing water, an intake port for taking air into the flow channel, and a valve mechanism which opens and closes the intake port. The valve mechanism, for example, blocks the intake port when the water is flowing in the flow channel, and opens the intake port to take air into the flow channel with the stop of the water flow. That is, the vacuum breaker 452 takes air into the pipe line 20*a* when there is no water flow in the water transfer part 20. A float valve is used for the valve mechanism, for example.

The vacuum breaker 452 promotes, for example, water drainage in a downstream portion from the vacuum breaker 452 in the pipe line 20*a* by taking air into the pipe line 20*a* as described above. The vacuum breaker 452 promotes, for example, water drainage of the nozzle 473. In this way, the vacuum breaker 452 drains the water in the nozzle 473 and takes air into the nozzle 473, and thus, for example, suppresses the wash water in the nozzle 473 and the liquid waste accumulated in the bowl 801 from flowing backward to the water supply source 10 (fresh water) side.

A pressure modulation part 454 is provided downstream of the vacuum breaker 452. The pressure modulation part 454 gives pulsation or acceleration to the water flow in the pipe line 20*a* of the water transfer part 20, and gives pulsation to the water discharged from the bottom wash water discharge port 474*a*, the soft wash water discharge port 474*b* and the bidet wash water discharge port 474*c* of the nozzle 473, and a water discharge part of the nozzle wash part 478. That is, the pressure modulation part 454 causes a flow condition of the water flowing in the pipe line 20*a* to fluctuate. The pressure modulation part 454 is connected to the control unit 405. The pressure modulation part 454 causes the flow condition of the water to fluctuate based on the control by the control unit 405. The pressure modulation part 454 causes the water pressure in the pipe line 20*a* to fluctuate.

A flow rate adjustment part 471 is provided downstream of the pressure modulation part 454. The flow rate adjustment part 471 performs adjustment of water force (flow rate). The flow channel switch part 472 is provided downstream of the flow rate adjustment part 471. The flow channel switch part 472 performs opening/closing and switching of water supply to the nozzle 473 and the nozzle wash part 478. The flow rate adjustment part 471 and the flow channel switch part 472 may be provided as one unit. The flow rate adjustment part 471 and the flow channel switch part 472 are connected to a control unit 405. The operations of the flow rate adjustment part 471 and the flow channel switch part 472 are controlled by the control unit 405.

The nozzle 473, the nozzle wash part 478, and a spray nozzle 479 are provided downstream of the flow channel switch part 472. The nozzle 473 receives drive force from a nozzle drive part 476, and advances into the bowl 801 of the toilet 800 and retreats from the bowl 801.

The nozzle wash part 478 washes an outer circumferential surface (body) of the nozzle 473, for example, by squirting the functional water or water from the water discharge part. The spray nozzle 479 sprays the wash water and the functional water to the bowl 801 in mist form. In this example, the spray nozzle 479 is provided separately from the nozzle 473 for washing the human body. Without being limited thereto, the nozzle 473 may be provided with the water discharge port for spraying mist-like liquid to the bowl 801.

A bottom wash flow channel 21, a soft wash flow channel 22, a bidet wash flow channel 23 which supply the water supplied from the water supply source 10 via the water transfer part 10 and the functional water produced in the electrolytic cell unit 450 to the nozzle 473 are provided downstream of the flow channel switch part 472. The bottom wash flow channel 21 connects the flow channel switch part 472 and the bottom wash water discharge port 474*a*. The soft wash flow channel 22 connects the flow channel switch part 472 and the soft wash water discharge port 474*b*. The bidet wash flow channel 23 connects the flow channel switch part 472 and the bidet wash water discharge port 474*c*.

A surface wash flow channel 24 and a spray flow channel 25 are provided downstream of the flow channel switch part 472. The surface wash flow channel 24 is configured to guide the water supplied from the water supply source 10 and the functional water produced in the electrolytic cell 450 to the water discharge part of the nozzle wash part 478 via the water transfer part 20. The spray flow channel 25 is configured to guide the water supplied from the water supply source 10 and the functional water produced in the electrolytic cell 450 to the spray nozzle 479 via the water transfer part 20.

The control unit 405 switches opening/closing of the flow channels of the bottom wash flow channel 21, the soft wash flow channel 22, the bidet was flow channel 23, the surface wash flow channel 24, and the spray flow channel 25 by controlling the flow channel switch part 472. In this way, the flow channel switch part 472 switches, for each of multiple water discharge ports such as the bottom wash water discharge port 474*a*, the soft wash water discharge port 474*b*, the bidet wash water discharge port 474*c*, the nozzle wash part 478, and the spray nozzle 479, a state in which the pile line 20*a* is in communication and a state in which the pipe line 20*a* is not in communication.

The control unit 405 is supplied with electrical power from a power source circuit 401 and controls the operations of the solenoid valve 431, the heat exchanger unit 440, the electrolytic cell unit 450, the pressure modulation part 454, the flow rate adjustment part 471, the flow channel switch part 472, and the nozzle drive part 476 based on signals from a human body detection sensor 403, the seat contact detection sensor 404, the flow rate sensor 442, and the operation unit 500 or the like.

As illustrated in FIG. 1, the human body detection sensor 403 is provided to be sunk into a recessed portion 409 made in the upper surface of the casing 400 and detects the user (the human body) approaching the toilet seat 200. In other words, the human body detection sensor 403 detects the user in the vicinity of the sanitary washing apparatus 100. Also, a transmissive window 310 is provided in a rear portion of the toilet lid 300. Therefore, the human body detection sensor 403 can detect the existence of the user via the transmissive window 310 in the state in which the toilet lid 300 is closed. The control unit 405, for example, automatically opens the toilet lid 300 based on the detection of the user by the human body detection sensor 403.

Various mechanisms such as a "warm air drying function" that dries the "bottom" and the like of the user sitting on the toilet seat 200 by blowing warm air toward the "bottom" and the like of the user, a "deodorizing unit," a "room heating unit,", etc., may be appropriately provided in the casing 400. In such a case, an exhaust port 407 from the deodorizing unit and a vent 408 from the room heating unit may be appropriately provided in the side surface of the casing 400. However, in the invention, it is not always necessary to provide sanitary washing functional units and other additional functional units.

Figure 3A:
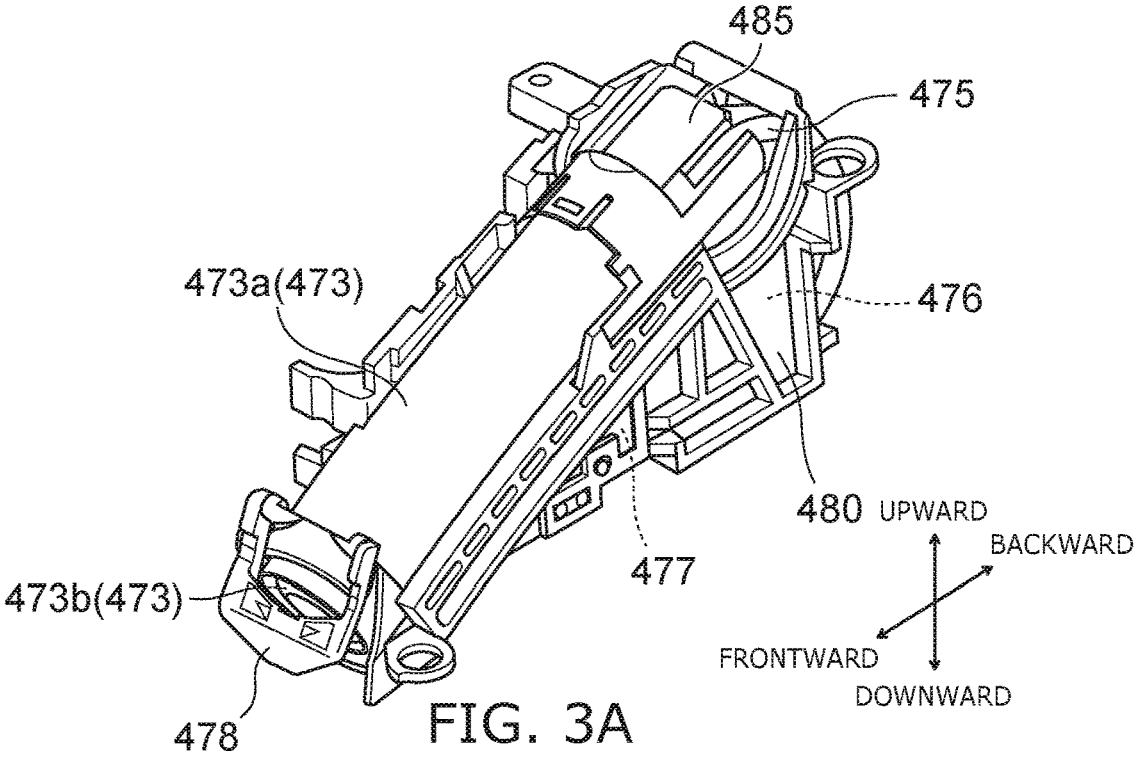
FIG. 3A and FIG. 3B are perspective views schematically illustrating the periphery of the private part washing nozzle of the sanitary washing apparatus according to the embodiment.
Figure 3B:
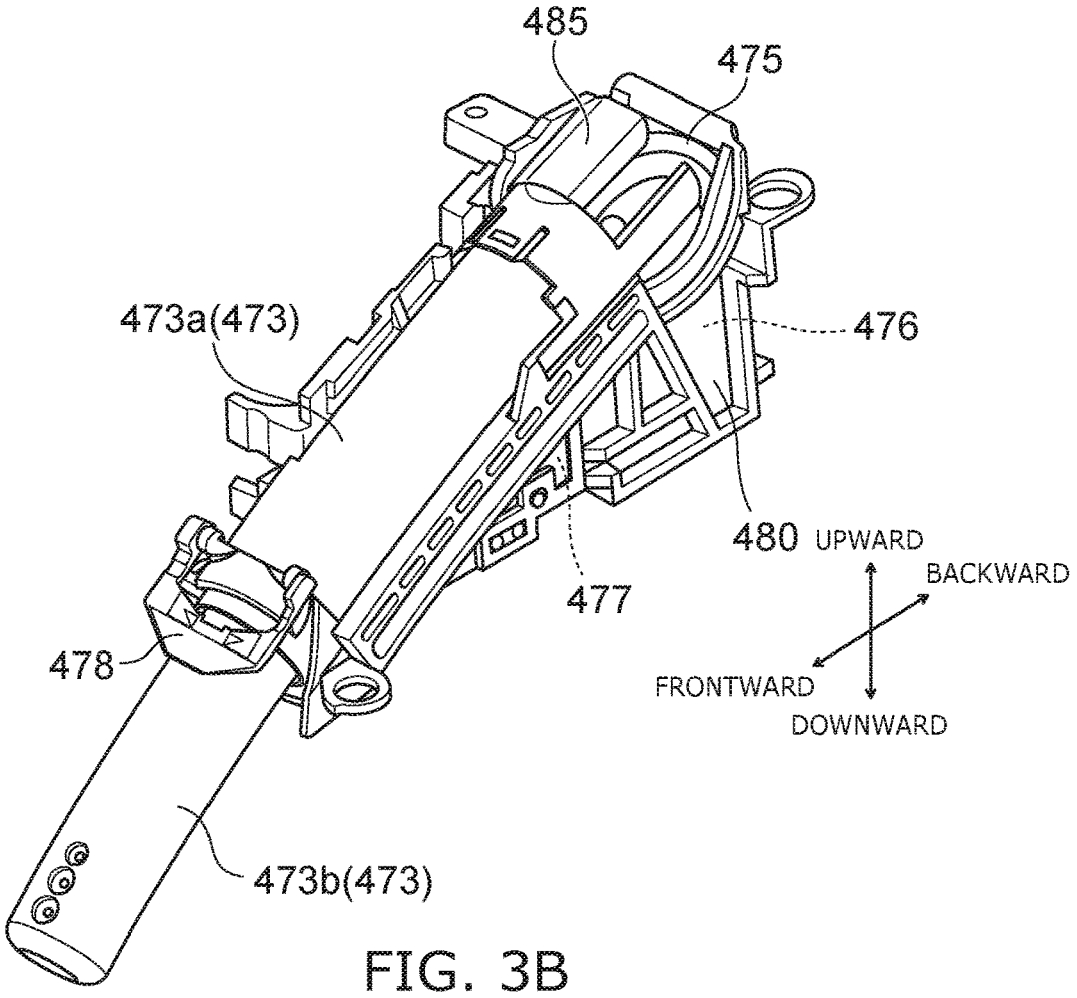

FIG. 3A and FIG. 3B are perspective views schematically illustrating the periphery of the private part washing nozzle of the sanitary washing apparatus according to the embodiment.

As illustrated in FIG. 3A and FIG. 3B, the nozzle 473 includes, for example, a first cylinder portion 473*a* and a second cylinder portion 473*b*. The first cylinder portion 473*a* advances from the casing 400. The second cylinder portion 473*b* advances from the first cylinder portion 473*a*. In this example, the second cylinder portion 473*b* is stored in the interior of the first cylinder portion 473*a*. The nozzle 473 is, for example, a so called multistage nozzle. In this way, the nozzle unit can be made smaller in a frontward and backward direction by making the nozzle 473 multistage. Thereby, the casing 400 can be made smaller in the frontward and backward direction.

The nozzle 473 is curved to be convex upward. In this way, the nozzle unit can be made smaller in a vertical direction by making the nozzle 473 curved upward in a convex shape. Thereby, the casing can be made smaller in the vertical direction.

The nozzle 473 is supported by a nozzle support part 480 provided under the nozzle 473. The nozzle 473 advances and retreats (advance and retreat) while moving (sliding) along an inclination of an upper surface of the nozzle support part 480. In other words, the inclination of the upper surface of the nozzle support part 480 is aligned with an orbit of the advance and retreat (virtual orbit VO described later) of the nozzle 473. In this example, the upper surface of the nozzle support part 480 inclines downward from backward toward frontward. The nozzle support part 480 may be, for example, a cylindrical member storing the nozzle 473.

At least of a portion of the nozzle drive part 476 which makes the nozzle 473 advance and retreat is provided, for example, under the nozzle 473. In this example, at least the portion of the nozzle drive part 476 is provided in the interior of the nozzle support part 480. In this way, by providing at least the portion of the nozzle drive part 476 under the nozzle 473, the space under the nozzle 473 can be effectively utilized as a range of motion of the nozzle drive part 476 and the casing 400 can be made smaller. The nozzle drive part 476 will be described later.

A tube 475 which supplies water to the nozzle 473 is connected to the nozzle 473. The tube 475 configures, for example, at least a portion of the bottom wash flow channel 21, the soft wash flow channel 22, and the bidet wash flow channel 23. One end (downstream side) of the tube 475 is connected to the nozzle 473, and other end (upstream side) of the tube 475 is connected to an incoming water connection part 477 which supplies water to the tube 475. For example, the portion of the tube 475 is positioned in the interior of the nozzle 473, and the other portion of the tube 475 is positioned outside the tube 475 (a first part 475*a* described later).

Figure 4A:
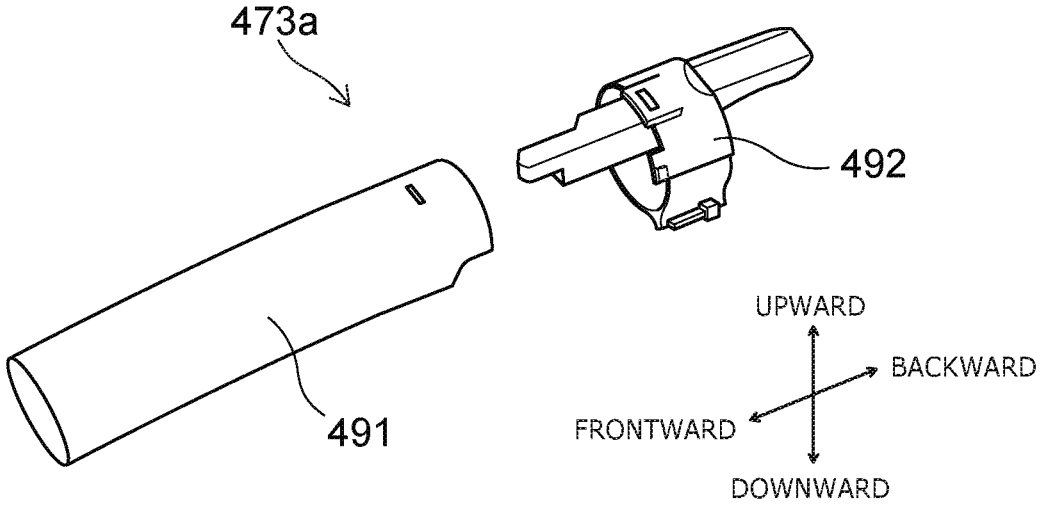
FIG. 4A and FIG. 4B are exploded perspective views schematically illustrating portions of the private part washing nozzle of the sanitary washing apparatus according to the embodiment.
Figure 4B:
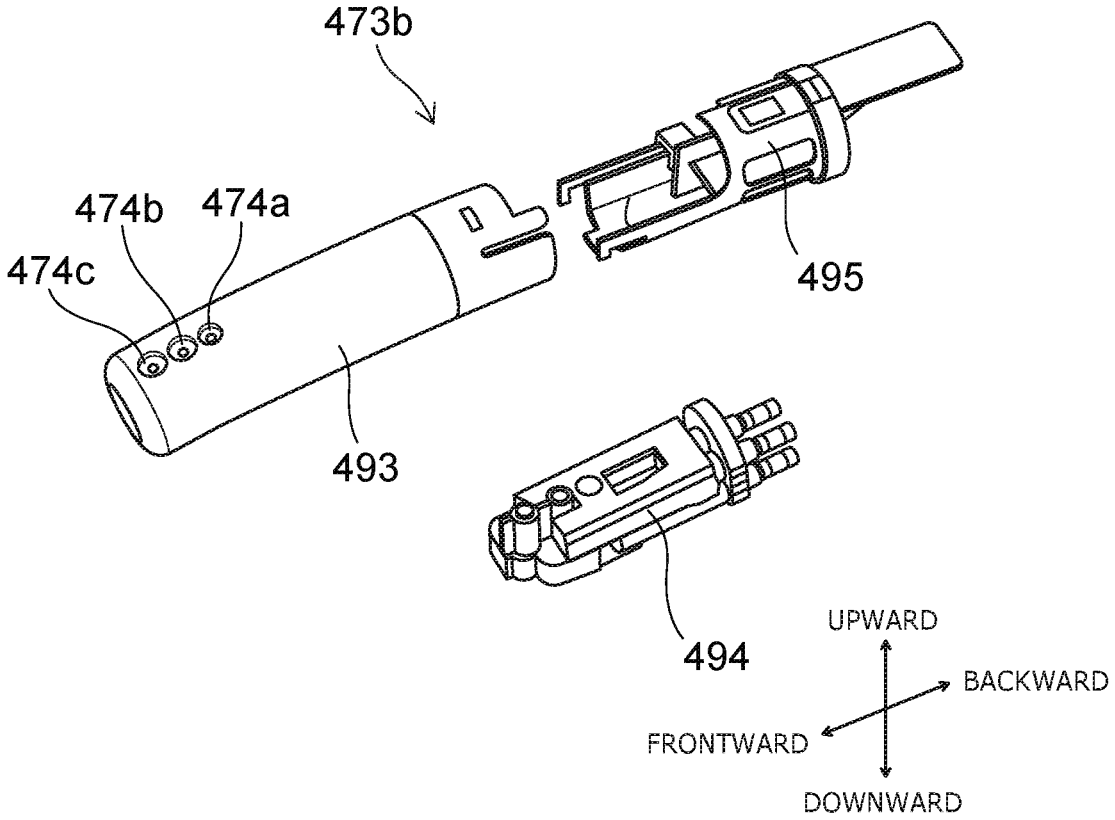

FIG. 4A and FIG. 4B are exploded perspective views schematically illustrating portions of the private part washing nozzle of the sanitary washing apparatus according to the embodiment.

FIG. 4A is an exploded perspective view schematically illustrating the first cylinder portion 473*a*.

FIG. 4B is an exploded perspective view schematically illustrating the second cylinder portion 473*b*.

As illustrated in FIG. 4A, the first cylinder portion 473*a* includes a first body portion 491 and a guide portion 492. The first body portion 491 has a hollow cylindrical shape that communicates in the frontward and backward direction, and is storing the second cylinder portion 473*b* in an internal space. A cross section of the first body portion 491 in the advance and retreat direction is, for example, substantially a true circle shape. The guide portion 492 has a hollow cylindrical shape that communicates in the frontward and backward direction, and is connected to a back end of the first body portion 491. The guide portion 492 guides a cable rack so that the cable rack of the nozzle drive part 476 does not contact the tube 475.

As illustrated in FIG. 4B, the second cylinder portion 473*b* includes a second body portion 493 and a nozzle head 494, and a drive connection portion 495. The second body portion 493 has a hollow cylindrical shape including an opening at a back end, and is storing the nozzle head 494 in an internal space. A cross section of the second body portion 493 in the advance and retreat direction is, for example, substantially a true circle shape. The bottom wash water discharge port 474*a*, the soft wash water discharge port 474*b*, and the bidet wash water discharge port 474*c* are provided on a front upper surface of the second body portion 493. The nozzle head 494 is provided under the bottom wash water discharge port 474*a*, the soft wash water discharge port 474*b*, and the bidet wash water discharge port 474*c* in the interior of the second body portion 493. The nozzle head 494 is connected to the tube 475, and discharges the water supplied from the tube 475 to the bottom wash water discharge port 474*a*, the soft wash water discharge port 474*b*, or the bidet wash water discharge port 474*c*. The tube 475 connected to the nozzle head 494 extends backward the nozzle 473 through an internal space of the drive connection portion 495. The drive connection portion 495 has a hollow cylindrical shape that communicates in the frontward and backward direction, and is connected to a back end of the second body portion 493. The drive connection portion 495 is connected to the cable rack of the nozzle drive part 476.

As described above, the nozzle 473 is curved to be convex upward. In other words, the first cylinder portion 473*a* and the second cylinder portion 473*b* are curved to be convex upward. More specifically, for example, the first body portion 491 of the first cylinder portion 473*a* and the guide portion 492, and the second body portion 493 of the second cylinder portion 473*b* and the drive connection portion 495 are curved to be convex upward.

An axis of the first cylinder portion 473*a* and an axis of the second cylinder portion 473*b* are, for example, aligned with the orbit of the advance and retreat of the nozzle 473 (virtual orbit VO described later). The axis of the first cylinder portion 473*a* and the axis of the second cylinder portion 473*b* have, for example, an arc shape having the same curvature radius (a first curvature radius CR1 described later) as the orbit of the advance and retreat of the nozzle 473. Alternatively, in the stored state, an axis of the overlapping portion of the first cylinder portion 473*a* and the second cylinder portion 473*b* is, for example, aligned with the orbit of the advance and retreat of the nozzle 473. In the stored state, the axis of the overlapping portion of the first cylinder portion 473*a* and the second cylinder portion 473*b* has, for example, an arc shape having the same curvature radius as the orbit of the advance and retreat of the nozzle 473.

For example, in the stored state, the water discharge ports (the bottom wash water discharge port 474*a*, the soft wash water discharge port 474*b*, and the bidet wash water discharge port 474*c*) provided on the second cylinder portion 473*b* are stored in the interior of the first cylinder portion 473*a*. In this way, in the stored state, the water discharge ports of the second cylinder portion 473*b* are stored in the interior of the first cylinder portion 473*a*, and thus the liquid waste or the like adhered to the periphery of the water discharge ports can be held back by the first cylinder portion 473*a* when storing. Thereby, the liquid waste or the like can be suppressed from dripping in the inner part of the casing 400, and the dirt can be suppressed from accumulating in the inner part of the casing 400.

As illustrated in FIG. 3A and FIG. 3B, the nozzle 473 includes, for example, a guide 485 which makes the tube 475 curved downward. The guide 485 is, for example, the first cylinder portion 473*a*. In this case, the guide 485 may be, for example, the first body portion 491 and may be the guide portion 492. The guide 485 may be, for example, the second cylinder portion 473*b*. In this case, the guide 485 may be, for example, the second body portion 493 and may be the drive connection portion 495. The guide 485 may be different depending on the position of the nozzle 473. For example, as illustrated in FIG. 3A, in the stored state, the second cylinder portion 473*b* (for example, drive connection portion 495) may be the guide 485, and as illustrated in FIG. 3B, in the advanced state, the first cylinder portion 473*a* (for example, guide portion 492) may be the guide 485. In this way, the nozzle 473 is provided with the guide 485, and thus the tube 475 can be suppressed from being curved upward when advancing and retreating the nozzle 473. Thereby, the tube 475 can be suppressed from interfering with the other members or the like above the nozzle 473. The first cylinder portion 473*a* is set to be the guide 485, and thus the tube 475 can be suppressed from curved upward by a more simple structure when advancing and retreating the nozzle 473.

Figure 5:
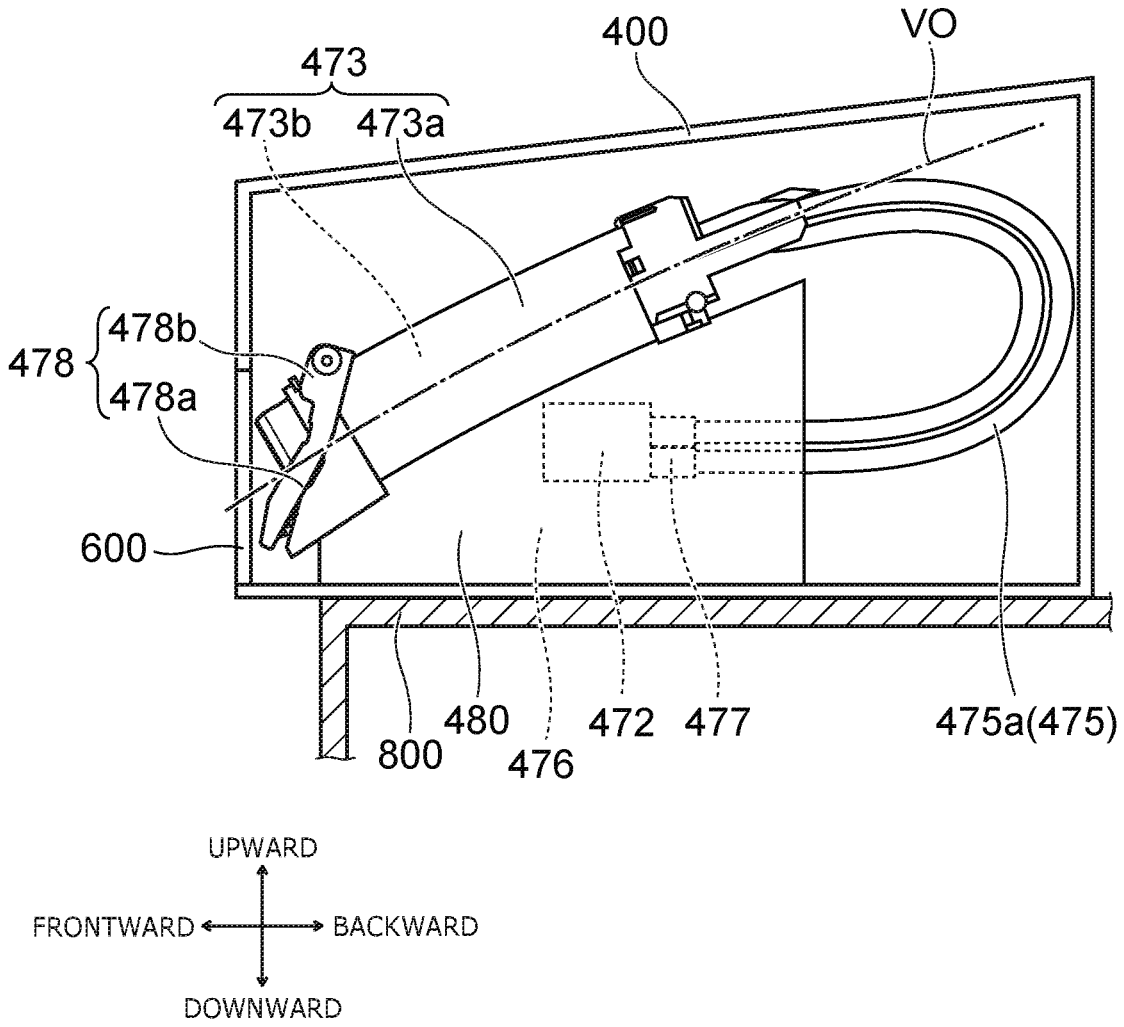
FIG. 5 is a side surface view schematically illustrating the periphery of the private part washing nozzle of the sanitary washing apparatus according to the embodiment.
Figure 6:
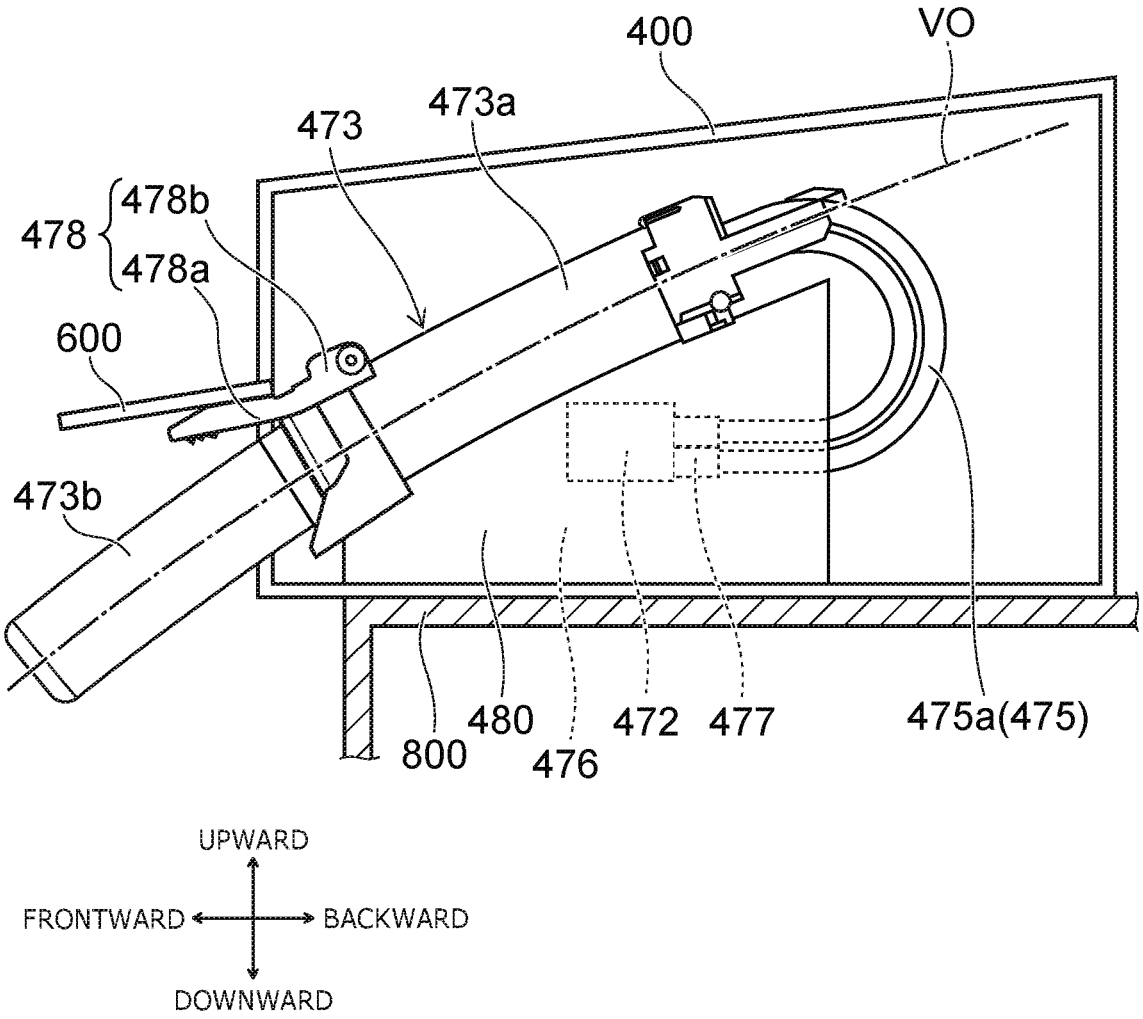
FIG. 6 is a side surface view schematically illustrating the periphery of the private part washing nozzle of the sanitary washing apparatus according to the embodiment.
Figure 7:
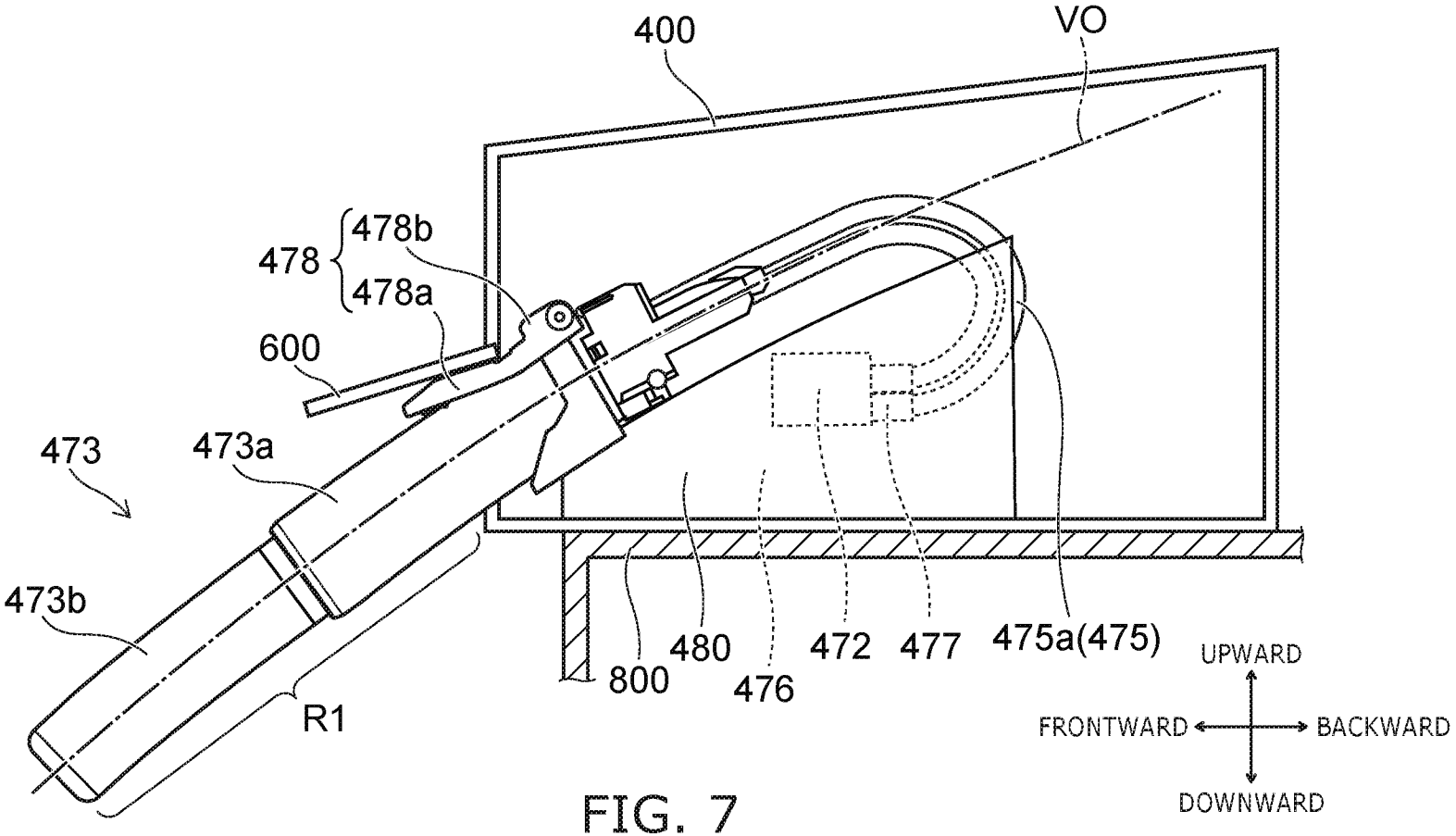
FIG. 7 is a side surface view schematically illustrating the periphery of the private part washing nozzle of the sanitary washing apparatus according to the embodiment.

FIG. 5 to FIG. 7 is side surface views schematically illustrating the periphery of the private part washing nozzle of the sanitary washing apparatus according to the embodiment.

As illustrated in FIG. 5 to FIG. 7, the sanitary washing apparatus 100 (casing 400) is installed on the toilet 800. The nozzle 473, the tube 475, the incoming water connection part 477, the flow channel switch part 472, the nozzle support part 480, the nozzle wash part 478, and the nozzle drive part 476 are stored in the interior of the casing 400. The nozzle 473 is possible to advance outside the casing 400.

A nozzle lid 600 is provided frontward of the nozzle 473. The nozzle lid 600 is provided to be openable and closable with respect to the opening provided frontward of the nozzle 473. The nozzle lid 600 is pivotally supported on a front surface of the casing 400. The nozzle lid 600 is in a closed state in which the opening is closed in the stored state in which the nozzle 473 is stored in the interior of the casing 400, as illustrated in FIG. 5, and in an open state in which the opening is opened in the advanced state in which the nozzle 473 advances from the casing 400, as illustrated in FIG. 6 and FIG. 7.

The nozzle wash part 478 is attached to a front end of the nozzle support part 480. The nozzle wash part 478 includes a member (water discharge part) 478*a* in which the water discharge hole discharging the wash water is formed, and its support body 478*b*. The nozzle wash part 478 washes the outer circumferential surface (body) of the nozzle 473, for example, by squirting the functional water or water from the water discharge part 478*a* when the nozzle 473 advances and retreats. In this example, the nozzle wash part 478 is configured separately from the nozzle support part 480. However the nozzle wash part 478 may be configured integrally with the nozzle support part 480.

The tube 475 includes a first part 475*a* positioned outward of the nozzle 473. In other words, the first part 475*a* is a portion exposed from the nozzle 473. The extent of the first part 475*a* is different depending on the position of the nozzle 473. For example, as illustrated in FIG. 5, in the stored state, the first part 475*a* is relatively long. On the other hand, as illustrated in FIG. 6 and FIG. 7, when the nozzle 473 advances, the first part 475*a* is taken in the interior of the nozzle 473 by the advancement of the nozzle 473, and the first part 475*a* becomes short.

As illustrated in FIG. 5, in the stored state, at least a portion of the first part 475*a* is curved in the same direction as the virtual orbit VO in a side surface view. In other words, in the stored state, at least the portion of the first part 475*a* is curved in the same direction as the virtual orbit VO in the vertical direction and the frontward and backward direction. As illustrated in FIG. 6 and FIG. 7, in the advanced state, at least the portion of the first part 475*a* is curved in the same direction as the virtual orbit VO in a side surface view. In other words, in the advanced state, at least the portion of the first part 475*a* is curved in the same direction as the virtual orbit VO in the vertical direction and the frontward and backward direction.

In this way, in the stored state, at least the portion of the first part 475*a* is curved in the same direction as the virtual orbit VO in a side surface view, and in the advanced state, at least the portion of the first part 475*a* is curved in the same direction as the virtual orbit VO in a side surface view, and thus the nozzle 473 can be advanced while keeping the curvature of the tube 475 in the stored state. Thereby, the bend and distortion or the like of the tube 475 when advancing and retreating the nozzle 473 can be suppressed, and the advance and retreat action of the nozzle 473 can be stabilized.

The incoming water connection part 477 is connected to the flow channel switch part 472. In other words, one end (downstream side) of the incoming water connection part 477 is connected to the upstream side of the tube 475, and the other end (upstream side) of the incoming water connection part 477 is connected to the flow channel switch part 472. In this example, a back end of the incoming water connection part 477 is connected to the upstream side of the tube 475, and a front end of the incoming water connection part 477 is connected to the flow channel switch part 472.

The incoming water connection part 477 and the flow channel switch part 472 are provided under the nozzle 473. In this example, the incoming water connection part 477 and the flow channel switch part 472 are provided in the interior of the nozzle support part 480. The tube 475 is installed under the nozzle 473. In other words, the tube 475 extends backward from the nozzle 473, is curved downward, is further curved frontward, and is connected to the incoming water connection part 477 provided under the nozzle 473. More specifically, for example, the first part 475*a* of the tube 475 is installed under the nozzle 473. In other words, the first part 475*a* of the tube 475 extends backward from the nozzle 473, is curved downward, is further curved frontward, and is connected to the incoming water connection part 477 provided under the nozzle 473.

In the specification, "under the nozzle 473" is a position under the virtual orbit VO in a side surface view, and not overlapping the nozzle 473 in a side surface view.

In this way, the tube 475 can be installed under the nozzle 473 by providing the incoming water connection part 477 under the nozzle 473. Thereby, a space under the nozzle 473 can be effectively utilized as a range of motion of the tube 475, and the casing 400 can be made smaller. Even when the liquid waste or the like is adhered to the tube 475, since the range of motion of the tube 475 is the space under the nozzle 473, the dirt can be suppressed from diffusing to the peripheral members and the inner part of the casing 400 by the motion of the tube 475.

The incoming water connection part 477 and the flow channel switch part 472 are provided, for example, in a range of ±45 degrees (namely, in a range of 90 degrees under the nozzle 473) across the perpendicular passing through the virtual orbit VO centering on a back end of the nozzle 473 in a front view. In other words, for example, a vertical component of a vector toward the incoming water connection part 477 from the back end of the nozzle 473 in a front view is larger than a horizontal component of this vector. The distortion of the tube 475 when advancing and retreating the nozzle 473 can be suppressed by providing the incoming water connection part 477 at such a position.

In this example, the incoming water connection part 477 and the flow channel switch part 472 are provided directly below the nozzle 473. In other words, the incoming water connection part 477 and the flow channel switch part 472 are provided at a position under the nozzle 473 and overlapping the nozzle 473 in a top view. In this way, the distortion of the tube 475 when advancing and retreating the nozzle 473 can be suppressed by providing the incoming water connection part 477 directly below the nozzle 473. Thereby, the actions of the nozzle 473 and the tube 475 can be more stable. The incoming water connection part 477 and the flow channel switch part 472 may be provided, for example, at a position under the nozzle 473 and not overlapping the nozzle 473 in a top view.

The incoming water connection part 477 is provided, for example, to be substantially horizontal or inclined upward from upstream toward downstream (from the flow channel switch part 472 side toward the tube 475 side). In this way, the incoming water connection part 477 is provided to be substantially horizontal or inclined upward from upstream toward downstream, and thus the tube 475 can be suppressed from interfering with a bottom plate of the casing 400. Thereby, it can be suppressed that when the nozzle 473 advances and retreats, the tube 475 interferes with the bottom plate of the casing 400 and friction occurs, and thus the load of the nozzle drive part 476 (motor) can be reduced.

In the following, the action of the nozzle 473 will be described.

As illustrated in FIG. 5, in a state in which the nozzle is not used, the entire nozzle 473 is stored in the interior of the casing 400. When private part washing is performed by the nozzle 473, as illustrated in FIG. 6, firstly the second tube part 473*b* advances from the first cylinder portion 473*a* front downward. At this time, the second cylinder portion 473*b* moves along the virtual orbit VO. When the second cylinder portion 473*b* moves front downward, the second cylinder portion 473*b* contacts the nozzle wash part 478, and the water discharge part 478*a* of the nozzle wash part 478 and the nozzle lid 600 are pushed upward. For example, while the second cylinder portion 473*b* reaches the prescribed position, the second cylinder portion 473*b* is washed by the discharged water from the water discharge part 478*a*.

When the second cylinder portion 473*b* reaches the prescribed position, as illustrated in FIG. 7, the first cylinder portion 473*a* moves front downward along the nozzle support part 480. At this time, the first cylinder portion 473*a* moves along the virtual orbit VO with the second cylinder portion 473*b* in a state in which the second cylinder portion 473*b* extends frontward from the first cylinder portion 473*a*. For example, while the first cylinder portion 473*a* reaches the prescribed position, the first cylinder portion 473*a* and the second cylinder portion 473*b* are washed by the discharged water from the water discharge part 478*a*.

As illustrated in FIG. 7, when the first cylinder portion 473*a* reaches the prescribed position, the water is discharged toward the private part of the user from the bottom wash water discharge port 474*a*, the soft wash water discharge port 474*b*, or the bidet wash water discharge port 474*c*, and washing is performed.

When the private part washing is completed, the nozzle 473 moves back upward toward the interior of the casing 400. When the nozzle 473 retreats, as illustrated in FIG. 6, firstly the first cylinder portion 473*a* retreats to the prescribed position. At this time, the first cylinder portion 473*a* moves along the virtual orbit VO with the second cylinder portion 473*b* in a state in which the second cylinder portion 473*b* extends frontward from the first cylinder portion 473*a*. For example, while the first cylinder portion 473*a* reaches the prescribed position, the first cylinder portion 473*a* and the second cylinder portion 473*b* are washed by the discharged water from the water discharge part 478*a*.

When the first cylinder portion 473*a* reaches the prescribed position, as illustrated in FIG. 5, the second cylinder portion 473*b* retreats back upward, and the second cylinder portion 473*b* is stored in the first cylinder portion 473*a*. At this time, the second cylinder portion 473*b* moves along the virtual orbit VO. When the second cylinder portion 473*b* is stored in the first cylinder portion 473*a*, the entire nozzle 473 is stored in the casing 400. For example, while the second cylinder portion 473*b* reaches the prescribed position, the second cylinder portion 473*b* is washed by the discharged water from the water discharge part 478*a*.

In this way, the water is discharged from the nozzle wash part 478 when the nozzle 473 is stored in the interior of the casing 400, and thus the nozzle 473 can be stored in the interior of the casing 400 after the liquid waste or the like adhered to the nozzle 473 is washed away. Thereby, the liquid waste or the like can be suppressed from dripping in the inner part of the casing 400, and the dirt can be suppressed from accumulating in the inner part of the casing 400. Since the nozzle 473 slips better by the water discharged from the nozzle wash part 478, the sliding resistance when storing the nozzle 473 can be smaller.

The water is discharged from the bottom wash water discharge port 474*a*, the soft wash water discharge port 474*b*, or the bidet wash water discharge port 474*c* in the state in which the second cylinder portion 473*b* is stored in the first cylinder portion 473*a*, and thereby the surface of the second cylinder portion 473*b* and the interior of the first cylinder portion 473*a* may be washed (self-cleaning).

As illustrated in FIG. 7, the nozzle 473 has a first region R1 positioned frontward of the nozzle wash part 478 in the state in which the nozzle 473 advances (for example, the state in which the first cylinder portion 473*a* and the second cylinder portion 473*b* advance). The first region R1 includes, for example, the first body portion 491 of the first cylinder portion 473*a* and the second body portion 493 of the second cylinder portion 473*b*. At least a portion of the first region R1 is exposed to the outside of the casing 400. That is, the first region R1 is a region where the liquid waste or the like is possibly adhered at the time of private part washing.

Figure 8:
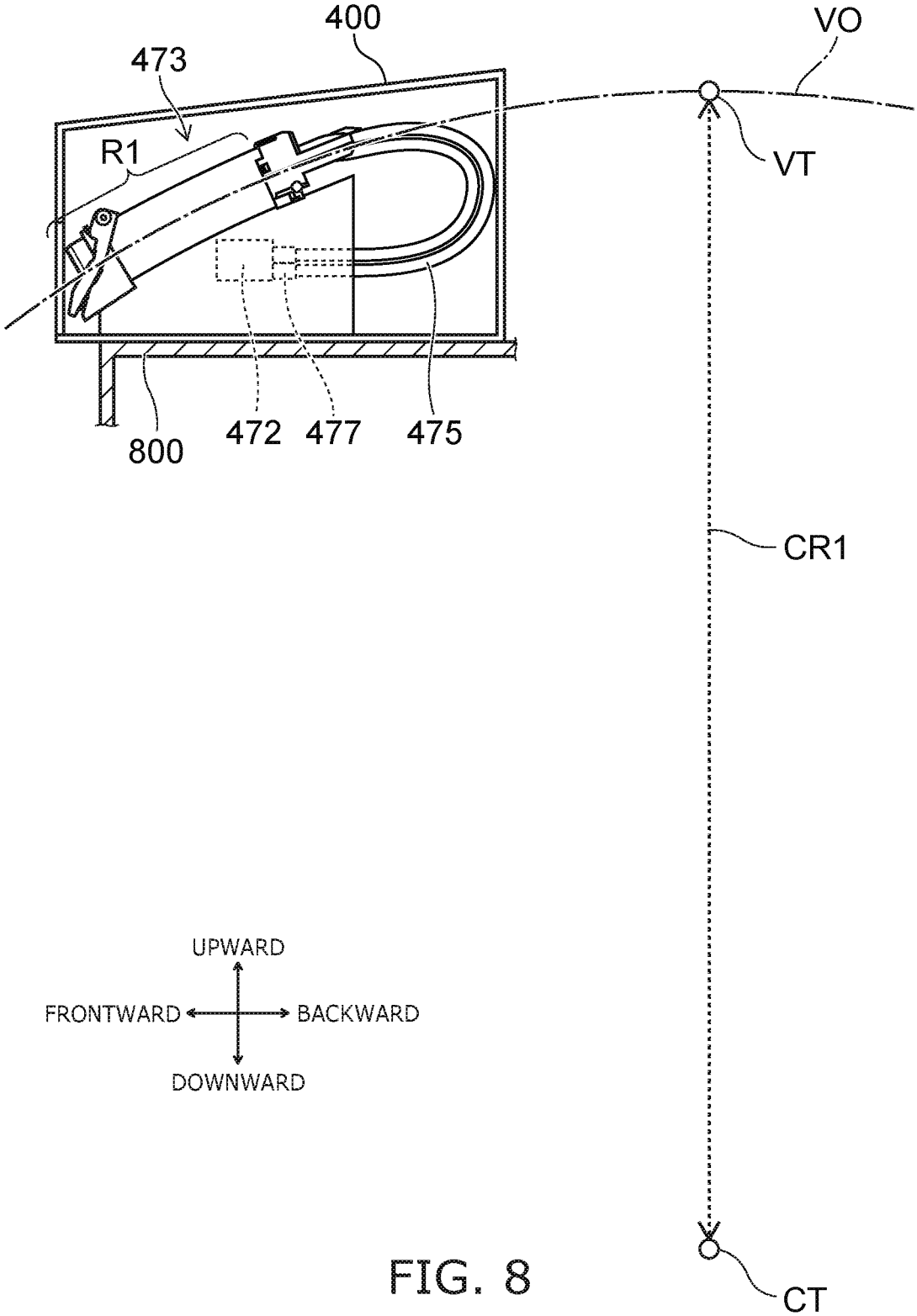
FIG. 8 is a side surface view schematically illustrating the periphery of the private part washing nozzle of the sanitary washing apparatus according to the embodiment.

FIG. 8 is a side surface view schematically illustrating the periphery of the private part washing nozzle of the sanitary washing apparatus according to the embodiment.

As illustrated in FIG. 8, in the stored state in which the nozzle 473 is stored in the interior of the casing 400, a back end of the first region R1 is positioned at a top VT of the virtual orbit VO or frontward of the top VT. In other words, in the stored state, the back end of the first region R1 does not exceed the top VT of the virtual orbit VO in the frontward and backward direction. The top VT is positioned directly above a curvature center CT of the virtual orbit VO.

The virtual orbit VO is an orbit of the advance and retreat of the nozzle 473. An axis of the nozzle 473 is aligned with the virtual orbit VO. The virtual orbit VO has, for example, an arc shape having the first curvature radius CR1. The first curvature radius CR1 is, for example, not less than 100 nm and not more than 800 mm, and preferred to be about 500 mm.

For example, if the back end of the first region R1 where the liquid waste or the like is possibly adhered at the time of private part washing is positioned backward of the top VT of the virtual orbit VO in the stored state, the liquid waste or the like adhered to the first region R1 will flow backward of the back end of the first region R1 along the nozzle 473. The liquid waste or the like will drip in the inner part of the casing 400, and the dirt will accumulate in the inner part of the casing 400.

In contrast to this, according to the embodiment, in the stored state, the back end of the first region R1 is set to be positioned at the top VT of the virtual orbit VO, or frontward of the top VT. Thereby, it can be suppressed that the liquid waste or the like adhered to the first region R1 flows backward of the back end of the first region R1 along the nozzle 473. Therefore, it can be suppressed that the liquid waste or the like drips in the inner part of the casing 400, and the dirt accumulates in the inner part of the casing 400.

As illustrated in FIG. 8, for example, in the stored state, the back end of the nozzle 473 is positioned at the top VT of the virtual orbit VO or frontward of the top VT. In other words, in the stored state, the back end of the nozzle 473 does not exceed the top VT of the virtual orbit VO in the frontward and backward direction. The back end of the nozzle 473 is, for example, a back end of the first cylinder portion 473*a*. The back end of the nozzle 473 is, for example, a back end of the guide portion 492 of the first cylinder portion 473*a*. The back end of the nozzle 473 may be, for example, a back end of the first cylinder portion 491 of the first cylinder portion 473*a*.

In this way, in the stored state, the back end of the nozzle 473 is set to be positioned at the top VT of the virtual orbit VO or frontward of the top VT, and thus the liquid waste or the like can be suppressed from flowing backward of the back end of the nozzle 473 in the stored state. Therefore, it can be further suppressed that the liquid waste or the like drips in the inner part of the casing 400 and the dirt accumulates in the inner part of the casing 400.

As illustrated in FIG. 8, for example, in the stored state, a back end of the tube 475 is positioned at the top VT of the virtual orbit VO or frontward of the top VT. In other words, for example, in the stored state, the back end of the tube 475 does not exceed the top VT of the virtual orbit VO in the frontward and backward direction. Thereby, the liquid waste or the like can be more surely suppressed from dripping in the inner part of the casing 400.

As illustrated in FIG. 8, for example, a back end of the casing 400 is positioned at the top VT of the virtual orbit VO or frontward of the top VT. In other words, for example, the back end of the casing 400 does not exceed the top VT of the virtual orbit VO in the frontward and backward direction. Thereby, the liquid waste or the like can be more surely suppressed from dripping in the inner part of the casing 400.

As illustrated in FIG. 8, for example, a back end of the incoming water connection part 477 is positioned frontward of the top VT of the virtual orbit VO. In this way, the back end of the incoming water connection part 477 is set to be positioned frontward of the top VT of the virtual orbit VO, and thus a length of the tube 475 can be ensured and bend of the tube 475 can be suppressed.

As illustrated in FIG. 8, for example, the back end of the incoming water connection part 477 is positioned frontward of the back end of the nozzle 473. In this way, the back end of the incoming water connection part 477 is set to be positioned frontward of the back end of the nozzle 473, and thus the length of the tube 475 can be ensured and the bend of the tube 475 can be suppressed.

As illustrated in FIG. 8, in the stored state, a front end of the nozzle 473 is positioned above the upper surface of the toilet 800. The upper surface of the toilet 800 is, for example, a surface contacting the toilet seat 200. The upper surface of the toilet 800 is, for example, an upper surface of a rim provided on the toilet 800. In this way, in the stored state, the front end of the nozzle 473 is set to be positioned above the upper surface of the toilet 800, and thus the front end of the nozzle 473 can be kept away from the toilet 800 as much as possible. Thereby, it can be further suppressed that the liquid waste or the like drips in the inner part of the casing 400 and the dirt accumulates in the inner part of the casing 400.

Figure 9A:
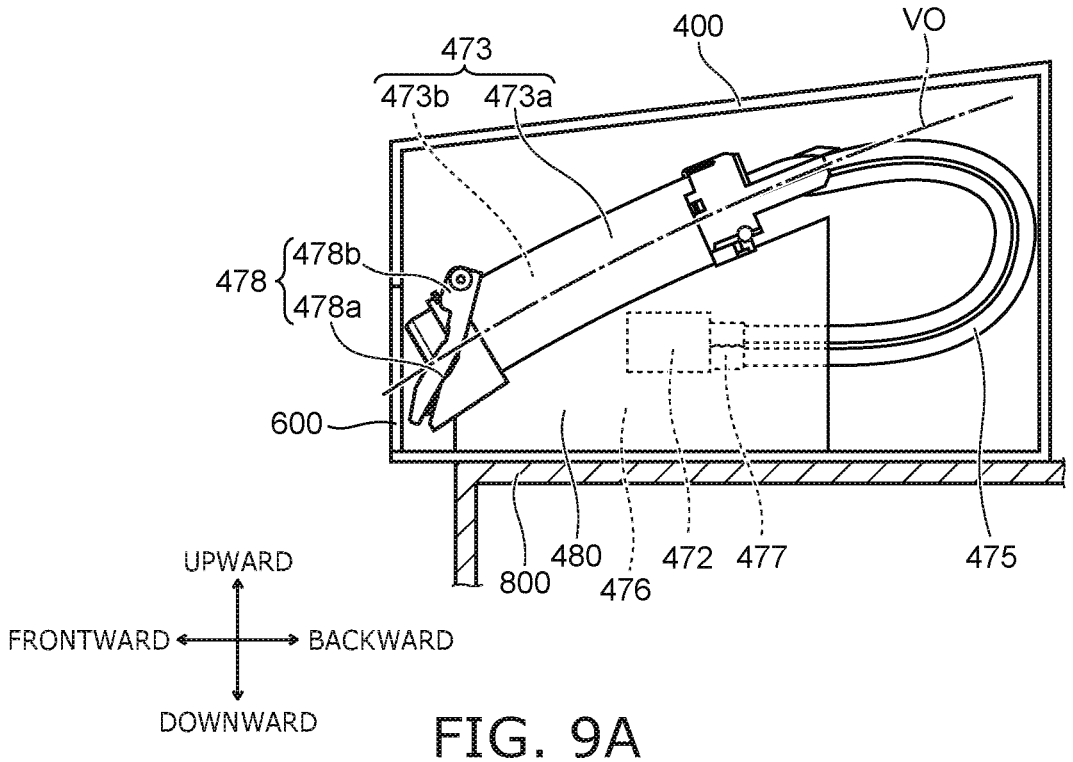
FIG. 9A and FIG. 9B are side surface views schematically illustrating the periphery of the private part washing nozzle of a modification of the sanitary washing apparatus according to the embodiment.
Figure 9B:
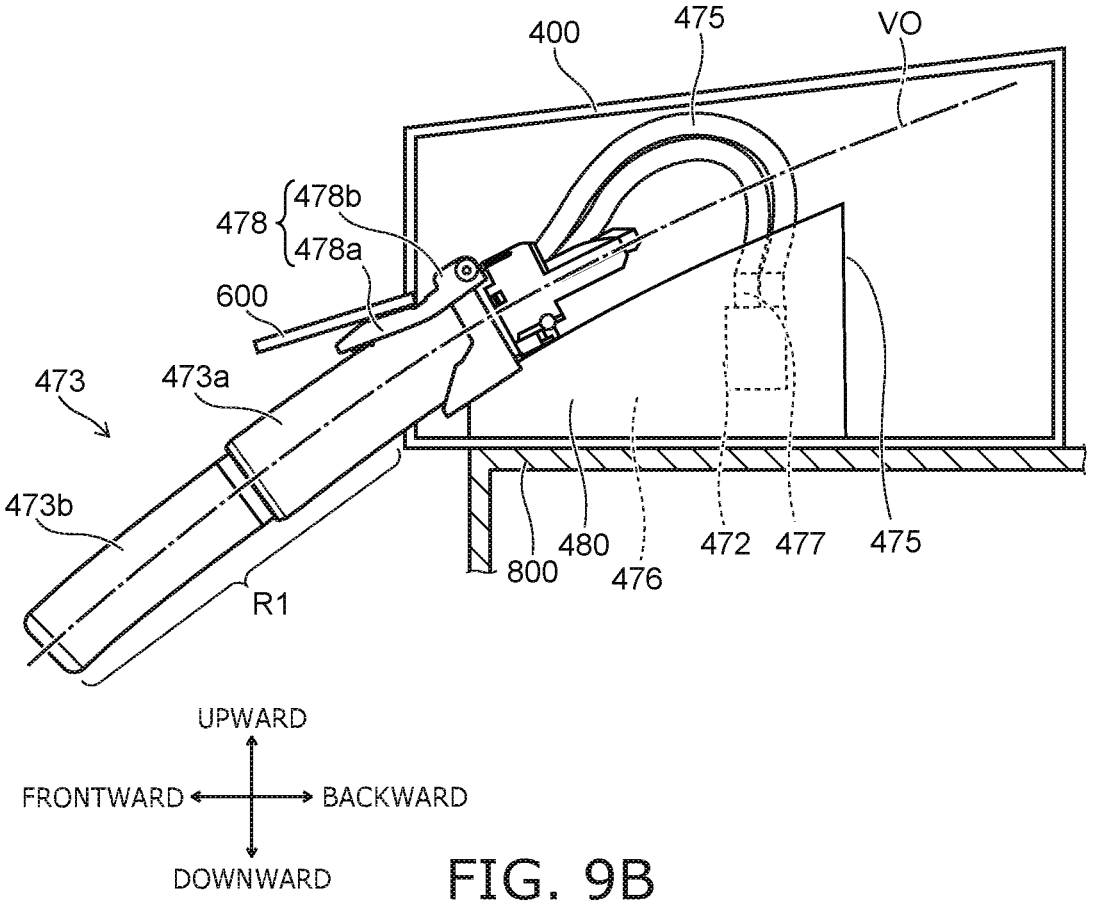

FIG. 9A and FIG. 9B are side surface views schematically illustrating the periphery of a private part washing nozzle of a modification of the sanitary washing apparatus according to the embodiment.

As illustrated in FIG. 9A, in the state in which the nozzle 473 is stored in the interior of the casing 400, the incoming water connection part 477 is connected to the tube 475 which extends from backward toward frontward, and the flow channel switch part 472 is positioned frontward of the incoming water connection part 477.

On the other hand, as illustrated in FIG. 9B, when the nozzle 473 advances, the flow channel switch part 472 and the incoming water connection part 477 rotate by about 90 degrees in a counter clockwise direction in FIG. 9A. In this state, the incoming water connection part 477 is connected to the tube 475 which extends from upward toward downward, and the flow channel switch part 472 is positioned under the incoming water connection part 477. When the nozzle retreats from the state shown in FIG. 9B, the flow channel switch part 472 and the incoming water connection part 477 rotate by about 90 degrees in a clock wise direction in FIG. 9A, and returns to the state shown in FIG. 9A. The angle made between the flow channel switch part 472 and the incoming water connection part 477 can be an arbitrary angle, however it is preferable to be an angle that reduces the force applied to the tube 475.

In this way, in this example, the flow channel switch part 472 and the incoming water connection part 477 are provided to be rotatable in accordance with the advance and retreat action of the nozzle 473. The flow channel switch part 472 and the incoming water connection part 477 rotate in accordance with the advance and retreat action of the nozzle 473, and thus even when the tube 475 positioned outside the nozzle 473 becomes short by the advancement of the nozzle 473, the bend of the tube 475 can be suppressed.

Figure 10:
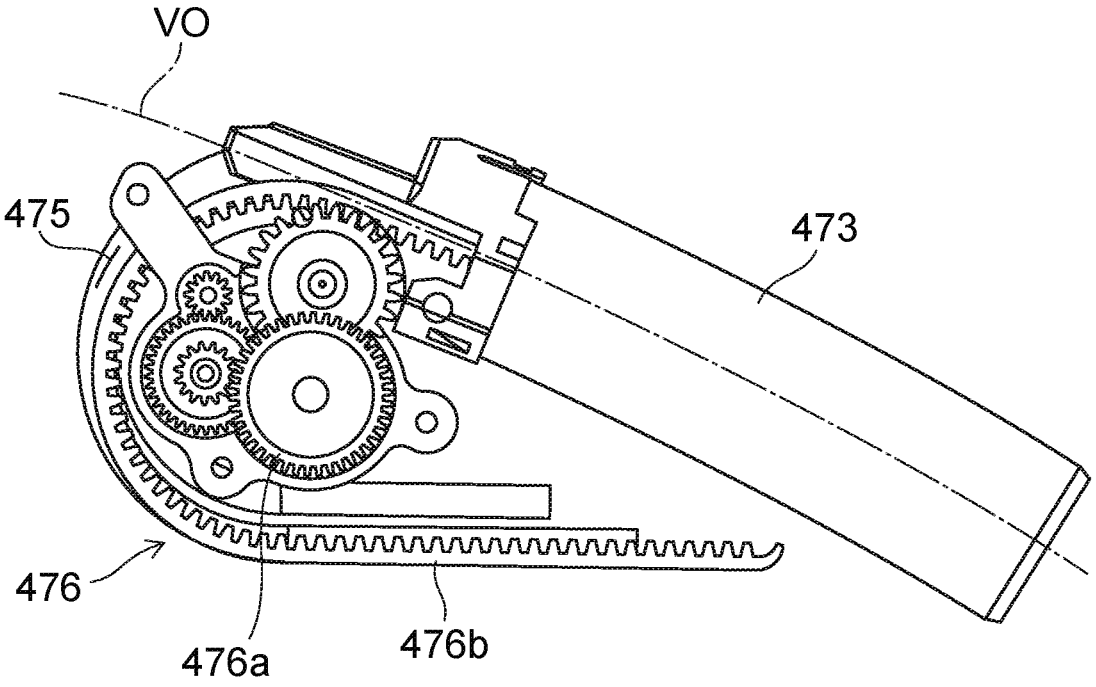
FIG. 10 is a side surface view schematically illustrating the periphery of the private part washing nozzle of the sanitary washing apparatus according to the embodiment.

FIG. 10 is a side surface view schematically illustrating the periphery of the private part washing nozzle of the sanitary washing apparatus according to the embodiment.

As illustrated in FIG. 10, the nozzle drive part 476 includes, for example, a motor (not illustrated), a gear 476*a*, and a cable rack (flexible rack gear) 476*b*. The nozzle drive part 476, for example, rotates the gear 476*a* by the motor and moves the cable rack, and thus advances and retreats the nozzle 473 connected to the cable rack 476*b*.

In this example, the cable rack 476*b* is curved in the same direction as the virtual orbit VO in a side surface view. In this way, the cable rack 476*b* is made curved in the same direction as the virtual orbit VO in a side surface view, and thus the nozzle 473 can be advanced while keeping the curvature of the cable rack 476*b*. Thereby, the distortion or the like of the cable rack 476*b* when advancing and retreating the nozzle 473 can be suppressed, and the advance and retreat action of the nozzle 473 can be stabilized.

In this example, the cable rack 476*b* is installed under the nozzle 473. In other words, the cable rack 476*b* is provided to extend backward from the nozzle 473, curved downward, and further curved frontward. For example, in the stored state in which the nozzle 473 is stored in the interior of the casing 400, an end portion of the cable rack 476*b* on a side where the cable rack 476*b* is not connected to the nozzle 473 is positioned under the nozzle 473.

In this example, in the stored state in which the nozzle 473 is stored in the interior of the casing 400, the cable rack 476*b* is provided to be along the tube 475. In other words, the curvature of the cable rack 476*b* is along the curvature of the tube 475.

Figure 11:
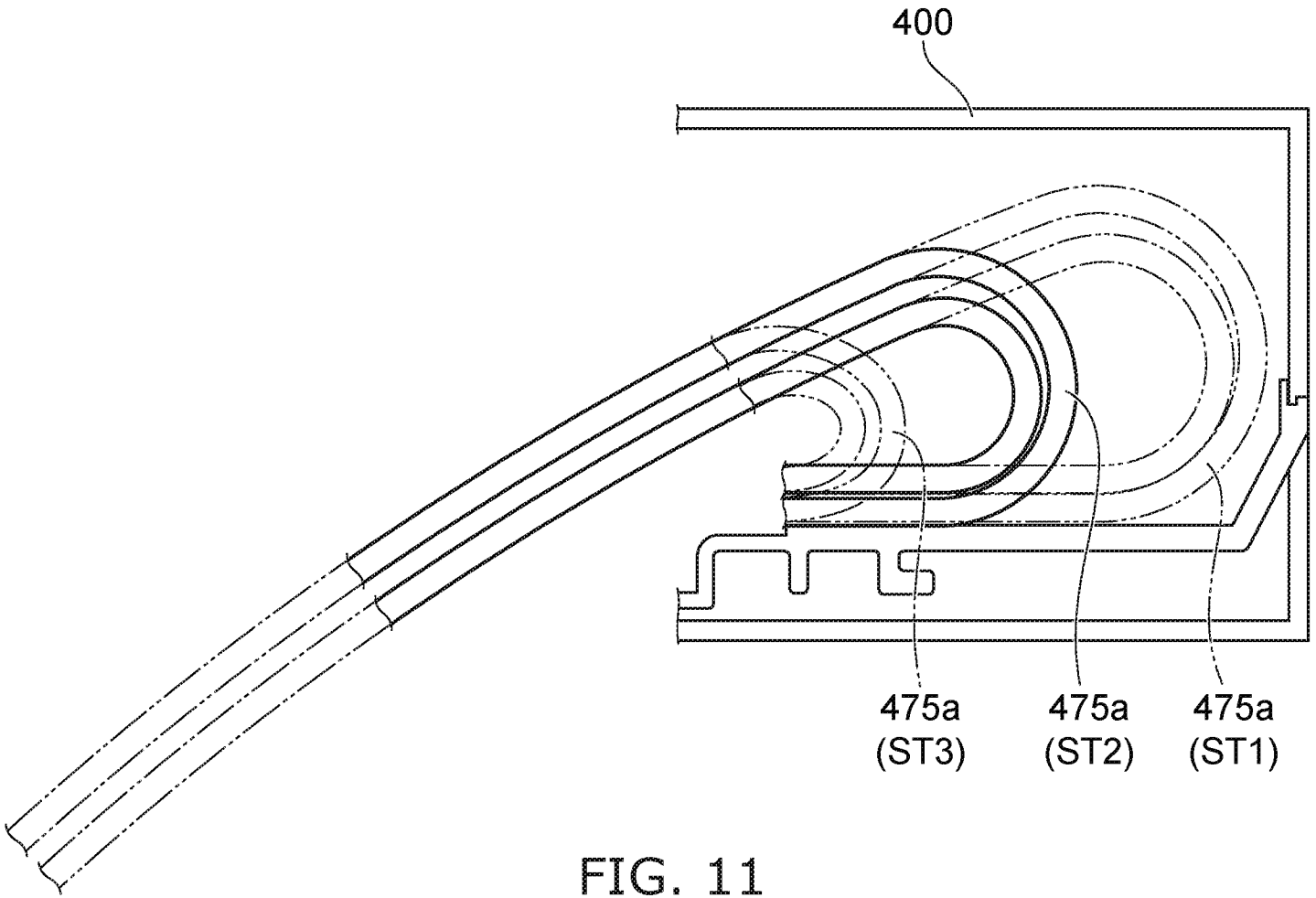
FIG. 11 is a side surface view schematically illustrating a curved shape of the tube at positions of the sanitary washing apparatus according to the embodiment.

FIG. 11 is a side surface view schematically illustrating a curved shape of the tube at positions of the sanitary washing apparatus according to the embodiment.

As illustrated in FIG. 11, for example, in the stored state illustrated in FIG. 5, the first part 475*a* of the tube 475 is in a state of ST1. In the advanced state illustrated in FIG. 6 with the advanced nozzle 473, the first part 475*a* of the tube 475 is in a state of ST2. In the advanced state illustrated in FIG. 7 with the further advanced nozzle 473, the first part 475*a* of the tube 475 is in a state of ST3.

When the nozzle 473 is advanced, the first part 475*a* of the tube 475 is in the state of ST2, and further in the state of ST3, while keeping the direction of the curvature of the ST1. On the other hand, when the nozzle 473 is retreated, the first part 475*a* of the tube 475 is in the state of ST2, and further in the state of ST1, while keeping the direction of the curvature of the ST3. According to the embodiment, in this way, the nozzle 473 can be advanced while keeping the curvature of the tube 475 in the stored state. Thereby, the bend and the distortion or the like of the tube 475 when advancing and retreating the nozzle 473 can be suppressed, and the advance and retreat action of the nozzle 473 can be stabilized.

As described above, according to the embodiment, when the nozzle 473 curved upward in a convex shape is provided, it can be suppressed that the dirt accumulates in the inner part of the casing 400 and the dirt diffuses by the tube 475.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. For example, the shape, the dimension, the material, the disposition, the installation feature or the like of the components included in the sanitary washing apparatus 100 are not limited to the illustration and can be appropriately modified.

The components included in the embodiments described above can be combined within the extent of technical feasibility, and any combined components also are included in the scope of the invention to the extent that the feature of the invention is included.

What is claimed is:

1. A sanitary washing apparatus, comprising:

a private part washing nozzle configured to wash a human body private part;

a tube configured to supply water to the private part washing nozzle;

an incoming water connection part connected to an upstream side of the tube and configured to supply water to the tube;

a casing storing the private part washing nozzle, the tube, and the incoming water connection part; and a nozzle wash part configured to wash the private part washing nozzle, the private part washing nozzle being curved upward to be convex, and advancing and retreating along a virtual orbit having an arc shape, the private part washing nozzle having a first region positioned frontward of the nozzle wash part in an advanced state in which the private part washing nozzle advances from the casing, in a stored state in which the private part washing nozzle is stored in an interior of the casing, a back end of the first region being positioned at a top positioned directly above a curvature center of an arc of the virtual orbit, or frontward of the top, the incoming water connection part being provided under the private part washing nozzle, and being rotatable in accordance with advance and retreat action of the private part washing nozzle, the incoming water connection part being rotatable from a first rotation position in the stored state to a second rotation position in accordance with advance of the private part washing nozzle, and a connection portion of the incoming water connection part and the tube being positioned at a backward side of the incoming water connection part in the first rotation position and being positioned at an upward side of the incoming water connection part in the second rotation position.

2. The sanitary washing apparatus according to claim 1, wherein in the stored state, a back end of the private part washing nozzle is positioned at the top or frontward of the top.

3. The sanitary washing apparatus according to claim 1, wherein the incoming water connection part is provided to be substantially horizontal or inclined upward from upstream toward downstream.

4. The sanitary washing apparatus according to claim 3, wherein a back end of the incoming water connection part is positioned frontward of the top.

5. The sanitary washing apparatus according to claim 1, wherein the private part washing nozzle includes a first cylinder portion advancing from the casing and a second cylinder portion advancing from the first cylinder portion, the second cylinder portion includes a water discharge port, and in the stored state, the water discharge port is stored in an interior of the first cylinder portion.

6. The sanitary washing apparatus according to claim 1, further comprising:

a cable rack for advancing the private part washing nozzle, the cable rack being curved in same direction as the virtual orbit in a side surface view.

7. The sanitary washing apparatus according to claim 1, wherein the tube includes a first part positioned outside the private part washing nozzle, in the stored state, at least a portion of the first part is curved in same direction as the virtual orbit in a side surface view, and in the advanced state, at least a portion of the first part is curved in same direction as the virtual orbit in a side surface view.

8. The sanitary washing apparatus according to claim 7, wherein the incoming water connection part is provided at a position overlapping the private part washing nozzle in a top view.

9. The sanitary washing apparatus according to claim 7, wherein the private part washing nozzle includes a guide which makes the tube curved downward.

10. The sanitary washing apparatus according to claim 9, wherein the private part washing nozzle includes a first cylinder portion advancing from the casing and a second cylinder portion advancing from the first cylinder portion, and the guide is the first cylinder portion.

11. The sanitary washing apparatus according to claim 7, further comprising:

a nozzle drive part which makes the private part washing nozzle advance and retreat, at least a portion of the nozzle drive part being provided under the washing nozzle.

* * * * *